United States Patent [19]

Grove et al.

[11] Patent Number: 5,076,291

[45] Date of Patent: Dec. 31, 1991

[54] METHOD AND APPARATUS FOR DETIPPING LOOSE CIGARETTES

[75] Inventors: Michael A. Grove, Richmond; Richard E. Thatcher, Deceased, late of Chester; Judith G. Shaw, Executrix, Clifton, all of Va.

[73] Assignee: Philip Morris Incorporated, New York, N.Y.

[21] Appl. No.: 460,361

[22] Filed: Jan. 3, 1990

[51] Int. Cl.[5] ..... A24C 1/04

[52] U.S. Cl. ..... 131/96

[58] Field of Search ..... 131/96

[56] References Cited

U.S. PATENT DOCUMENTS

| | | | |
|---|---|---|---|
| 2,815,029 | 12/1957 | Exner | 131/20 |
| 2,976,872 | 3/1961 | Morphet et al. | 131/96 |
| 3,026,880 | 3/1962 | Perrin | 131/96 |
| 3,103,222 | 9/1963 | Di Ianni | 131/96 |
| 3,224,451 | 12/1965 | Dearsley | 131/20 |
| 3,233,613 | 2/1966 | Korber et al. | 131/20 |
| 3,404,688 | 10/1968 | Pinkham et al. . | |
| 3,665,931 | 5/1972 | Mizzau | 131/21 R |
| 3,757,799 | 9/1973 | Di Ianni et al. | 131/96 |
| 4,117,852 | 10/1978 | Newman et al. | 131/96 |
| 4,485,827 | 12/1984 | Komossa et al. | 131/84 C |

FOREIGN PATENT DOCUMENTS

| | | |
|---|---|---|
| 0192372 | 8/1986 | European Pat. Off. . |
| 66/4180 | 10/1987 | South Africa . |
| 763999 | 12/1956 | United Kingdom . |

*Primary Examiner*—V. Millin
*Assistant Examiner*—Lynne A. Reichard
*Attorney, Agent, or Firm*—Jeffrey H. Ingerman

[57] ABSTRACT

The method and apparatus of this invention relates to the detipping of cigarettes at high speed without degradation of the tobacco in the tobacco rod and regardless of the intial orientation of the filter tip and the tobacco rod in the apparatus. Cigarettes are fed onto a conveyor belt so that they are traveling in a direction perpendicular to their longitudinal axis. A rolling belt disposed above the conveyor belt straightens bent cigarettes and rolls uneven cigarettes. The cigarettes are then fed onto a fluted rotating drum and aligned on the drum by means of an optical sensor and an air jet so that the filter tip portion of each cigarette is adjacent either side of the drum. Rotating knives are properly oriented so they engage the cigarettes only at the point where the filter tip is connected to the tobacco rod and cut off the filters of the cigarettes.

81 Claims, 4 Drawing Sheets

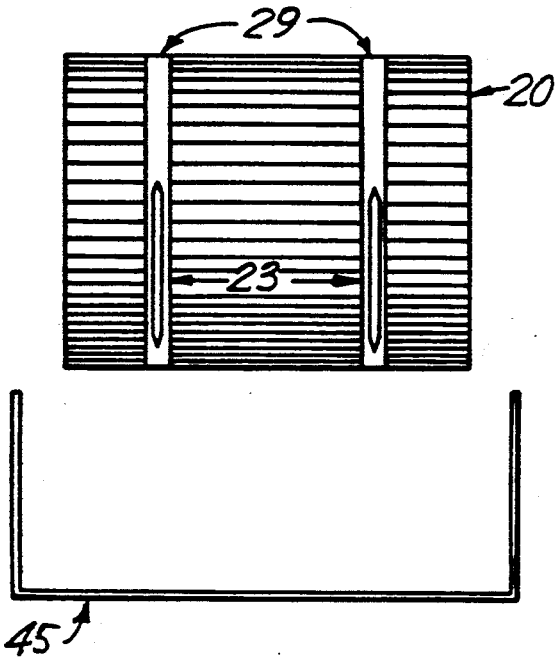
FIG. 6
FIG. 7
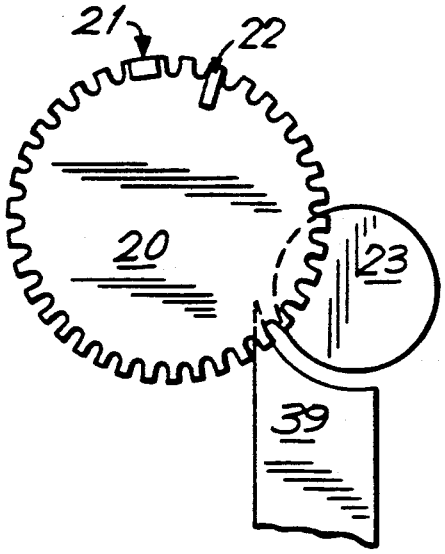
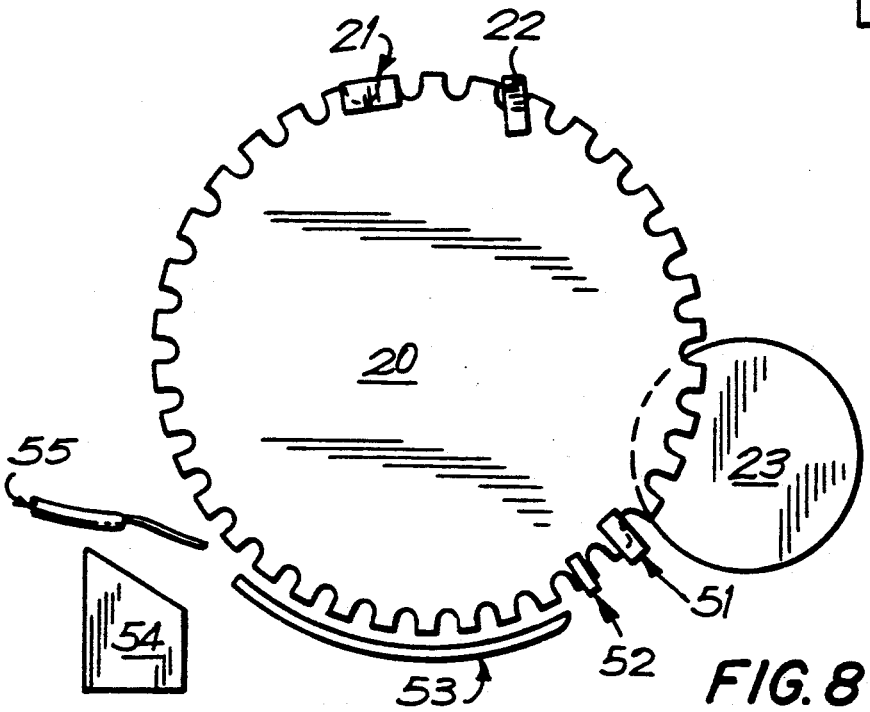
FIG. 8

METHOD AND APPARATUS FOR DETIPPING LOOSE CIGARETTES

BACKGROUND OF THE INVENTION

This invention relates to a method and apparatus for removing filter tips from scrap filter tipped cigarettes at high speed while avoiding degradation of the tobacco.

In the manufacture of cigarettes, some substandard cigarettes will be produced, i.e., cigarettes having insufficient amounts of tobacco or unevenly distributed tobacco, and some cigarettes will be damaged during the manufacturing process. These cigarettes are rejected before being packaged to ensure that the cigarettes that reach the consuming public will be of the highest quality. Although these cigarettes are rejected, the tobacco contained therein is perfectly suitable for use in a cigarette. Therefore, cigarette manufacturers have employed various methods to reclaim the tobacco from cigarettes rejected during the manufacturing process.

In order to reclaim tobacco from rejected filter cigarettes successfully, it is necessary to remove the filter tip portion from the cigarettes. Many devices have been employed to detip filter cigarettes. However, all of these prior art detipping devices require that the cigarettes be carefully oriented, generally with the filter tip portion of the cigarettes all facing in one direction. This is necessary to ensure that the filters are completely removed from the cigarettes, that the filters are not cut which would allow the filter material to contaminate the tobacco and that the tobacco in the tobacco rod is not cut rendering the tobacco unusable for another cigarette.

The requirement that the cigarettes be fed into the detipping device in one particular orientation is undesirable because careful handling of the cigarettes is required to ensure proper alignment. However, even with careful handling of the cigarettes, with the high speed at which these detipping machines operate, there are bound to be a substantial number of cigarettes that are improperly oriented as they are fed into the detipping machine. The result will be substantial numbers of cigarettes having the tobacco rod cut with a portion of the tobacco rod still attached to the filter tip or substantial numbers of cigarettes having the filter cut causing the filter material to contaminate the tobacco to be reclaimed.

In addition to the aforementioned problems with prior art detipping devices, another problem is that these detipping devices cannot adequately process broken or bent cigarettes. These cigarettes must be removed for processing by other means prior to being fed into the detipping device.

It would be desirable to provide a method and apparatus for detipping cigarettes that do not require the cigarettes to be fed into the detipping device with the filter tips all facing in one direction.

It also would be desirable to provide a method and apparatus for detipping cigarettes that will remove the filter tips from the cigarettes without degradation of the tobacco.

It further would be desirable to provide a method and apparatus that will detip cigarettes without filter material contaminating the tobacco regardless of the orientation of the cigarettes in the detipping device.

It still further would be desirable to provide a method and apparatus for detipping cigarettes at high speeds.

It yet further would be desirable to provide a method and apparatus for detipping cigarettes that will allow the removal of broken or bent cigarettes to prevent interference with the detipping of whole cigarettes.

SUMMARY OF THE INVENTION

It is an object of this invention to provide a method and apparatus for detipping cigarettes that do not require the cigarettes to be fed into the detipping device with the filter tips all facing in one direction.

It is another object of this invention to provide a method and apparatus for detipping cigarettes that will remove the filter tips from the cigarettes without degradation of the tobacco.

It is yet another object of this invention to provide a method and apparatus for detipping cigarettes that will prevent filter material from contaminating the tobacco regardless of the orientation of the cigarettes in the detipping device.

It is a further object of this invention to provide a method and apparatus for detipping cigarettes at high speeds.

It is still another object of this invention to provide a method and apparatus for detipping cigarettes that will allow the removal of broken or bent cigarettes to prevent interference with the detipping of whole cigarettes.

In accordance with this invention, there is provided an apparatus with a feed bin, a rotating fluted drum, slide rails, a conveyor belt, a second rotating fluted drum, a photocell, air jets and a pair of rotating knives all properly arranged to detip filter cigarettes at high speeds without requiring the cigarettes to all be aligned in one particular direction.

The feed bin accepts cigarettes to be detipped and feeds them onto the flutes of a rotating fluted drum. This rotating fluted drum transfers the cigarettes onto slide rails. Broken cigarettes drop through the slide rails for reclamation by another means. This allows only whole cigarettes to be detipped by the method and apparatus of this invention. Cigarettes then roll onto the conveyor belt from the slide rails so that the cigarettes are traveling in a direction perpendicular to their longitudinal axis. A second rotating fluted drum carries the cigarettes from the conveyor belt to rotating knives for detipping. The cigarettes are all carried along one side of the second fluted drum. Prior to arriving at the rotating knives, a photocell senses the cigarettes on the second fluted drum and determines whether the filter tip or the tobacco rod is facing the photocell. Depending on the orientation of each cigarette, an air jet may blow certain cigarettes to the other side of the second fluted drum. In this way, each cigarette will be oriented so that only the filter tip portion is adjacent either side of the second fluted drum. The rotating knives are positioned adjacent the fluted drum so they cut off only the filter tip portions of the cigarettes. The fluted drums may be changed to provide different drum widths, flute sizes or to change the number of flutes on a drum. This will allow different size and different length cigarettes to be detipped.

Also in accordance with this invention, there is provided a method involving carrying cigarettes to a detipping station, sensing the orientation of the cigarettes on a fluted drum, aligning each cigarette so the filter tip portions of the cigarettes are all adjacent to one or the other side of the fluted drum and cutting off the filter tip portions of the cigarettes.

BRIEF DESCRIPTION OF THE DRAWINGS

The above and other objects and advantages of this invention will be apparent upon consideration of the following description taken in conjunction with the accompanying drawings, in which like reference characters refer to like parts throughout, and in which:

FIG. 6 is a partial sectional view taken along lines 6—6 of FIG. 2;

FIG. 7 is a schematic side view of the detipping station of another embodiment of the invention; and FIG. 8 is a schematic side view of the detipping station of yet another embodiment of the invention.

DETAILED DESCRIPTION OF THE INVENTION

General Overview

A suitable hopper or feeder bowl 10 is employed to transfer the filter cigarettes from the feed bin (not shown) which temporarily stores a supply of cigarettes and may assume any satisfactory configuration.

Figure 2:
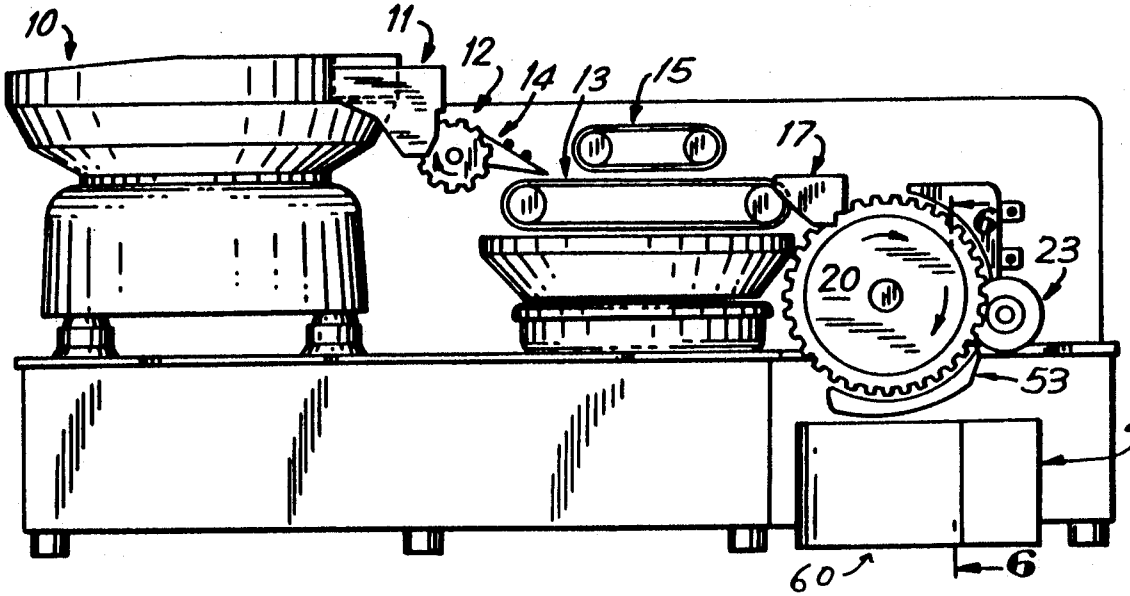
FIG. 2 is a front elevation view of an embodiment of the invention.
Figure 3:
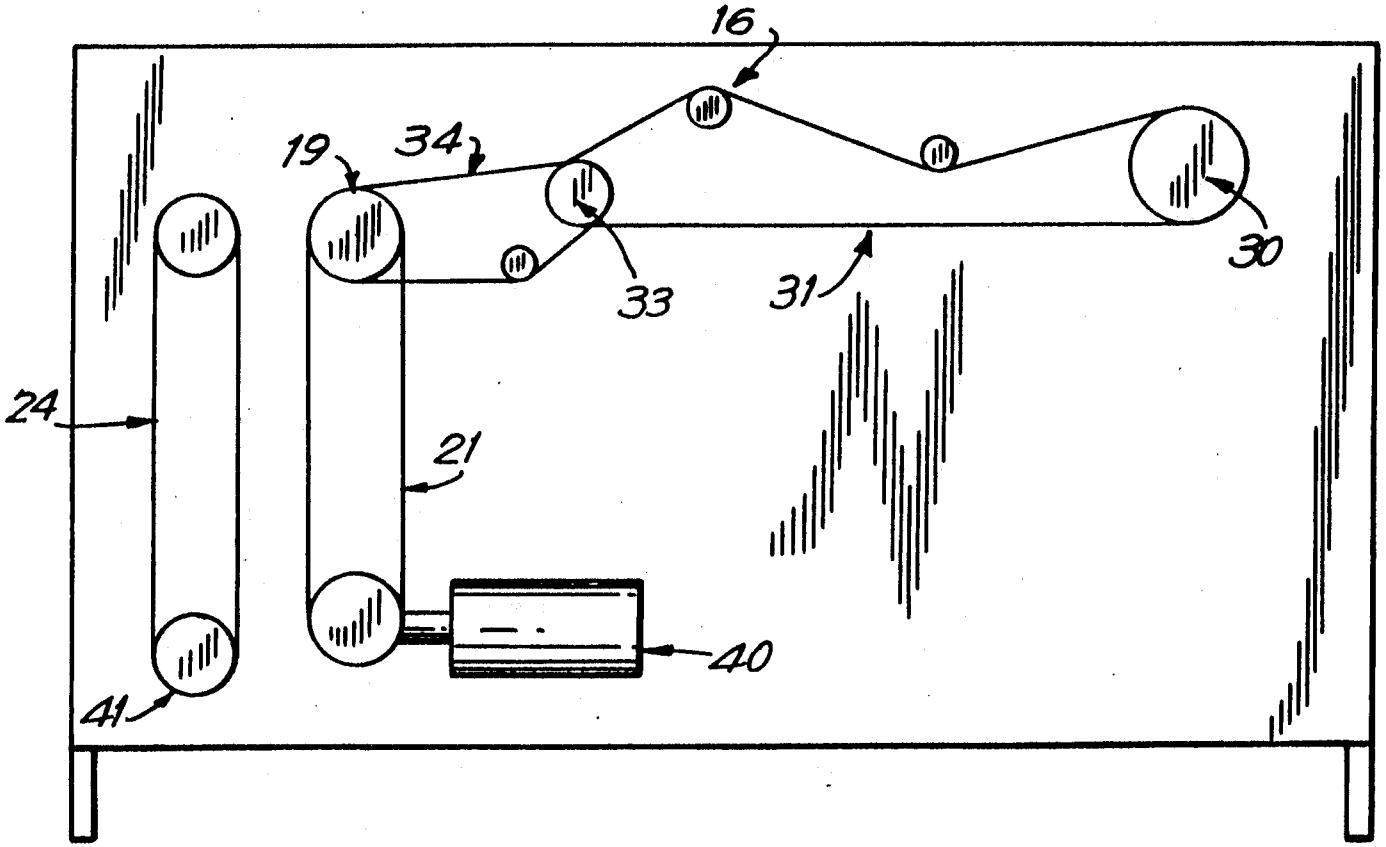
FIG. 3 is a schematic rear elevation view of the drive system for an embodiment of the invention.
Figure 4:
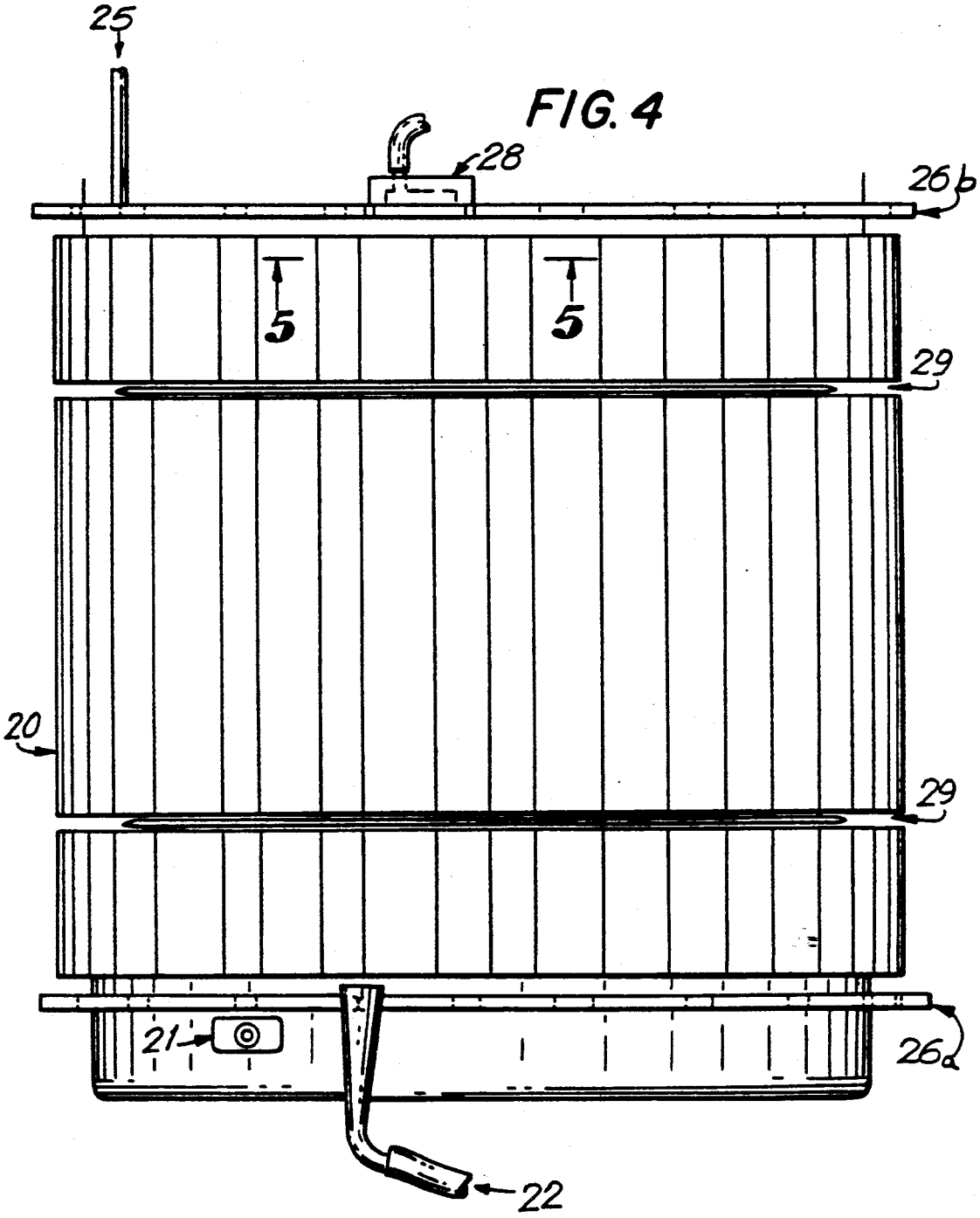
FIG. 4 is an enlarged view of the detipping station of an embodiment of the invention.

A suitable conveying means is employed to convey the filter cigarettes from feeder bowl 10 to the detipping station. A fluted drum 12 rotating clockwise as shown in FIG. 2 picks up cigarettes from feeder bowl 10 via a transfer chute 11. Rotating fluted drum 12 transfers the cigarettes to a pair of slide rails 14. Slide rails 14 are laterally separated by a distance slightly less than the length of a whole cigarette. This allows broken cigarettes to fall between slide rails 14 to ensure that only whole cigarettes are subjected to the detipping operation. The cigarettes then roll onto conveying means 13 such as a conveyor belt.

A rolling belt 15 may be positioned above conveying means 13 a distance equal to about the average diameter of a typical filter cigarette. As cigarettes are carried along on conveying means 13 and pass below rolling belt 15, bent cigarettes are straightened and uneven cigarettes are rolled to improve flatness. Also, rolling belt 15 ensures that the cigarettes remain oriented so they travel in a direction perpendicular to their longitudinal axis. This operation facilitates proper alignment of the cigarettes in the flutes of the second fluted drum 20 at the detipping station.

From conveying means 13, the cigarettes are transferred onto drum 20 via another transfer chute 17. The cigarettes are picked up by the flutes of drum 20 from transfer chute 17. Drum 20 also rotates clockwise as shown in FIG. 2.

If the cigarettes are not initially carried along one side of drum 20, one or more air jets 25 located on one or the other side of drum 20 may be used to move all of the cigarettes to one side of drum 20. Back stops **26*a* and 26*b* may be placed adjacent to the sides of drum 20 to ensure that the cigarettes are not blown off of drum 20 as the cigarettes are positioned by air jet 25** and to properly align the cigarettes for detipping.

Sensing means 21, such as a photocell, is positioned adjacent drum 20 downstream of air jet 25. Preferably sensing means 21 is positioned near the side of drum 20 along which the cigarettes are initially located, either by transfer chute 17 or by air jet 25. Sensing means 21 determines whether the filter tip or the tobacco rod of the cigarette is facing it. In the preferred embodiment, sensing means 21 determines whether the tobacco rod is facing it.

Positioning means 22, such as another air jet, is arranged and operated to ensure that only the filter tip portion or only the tobacco rods of all the cigarettes is adjacent the outside of drum 20. In the preferred embodiment, where sensing means 21 determines that the tobacco rod of a cigarette is facing sensing means 21, positioning means 22 blows the cigarette to the other side of drum 20 where the cigarette is stopped by back stop **26*b*. A vacuum block 28 at back stop 26*b* may be used to initially hold the cigarette against back stop 26*b* and not allow the cigarette to bounce away. This procedure ensures that only the filter tip portion of the cigarettes are adjacent the sides of drum 20**.

After the cigarettes have been properly oriented, drum 20 carries the cigarettes through a pair of rotating cutting means 23 such as rotating disk knives. Cutting means 23 are positioned so that the cigarettes are cut only at about the point where the filter tip portion is connected to the tobacco rod. Appropriate recovery means 45 and 60 may be placed adjacent to drum 20 to collect the tobacco rods and the filter tip portions after the cigarettes have been detipped. A second sensing means 51 may be placed downstream of cutting means 23 to determine if the cigarettes have been properly detipped. Improperly detipped cigarettes may be deposited in a second recovery means 54.

The Feed Bin And The Feeder Bowl

As indicated earlier, the feed bin (not shown) and feeder bowl 10 may assume any satisfactory form or size. For optimal performance, the feed bin and feeder bowl 10 should permit the cigarettes to flow without undue interruption. Preferably, the feed bin and feeder bowl 10 are vibratory. The vibratory feed bin causes cigarettes to be emptied from the feed bin to feeder bowl 10. Vibratory feeder bowl 10 causes the cigarettes to travel around feeder bowl 10 to transfer chute 11. The cigarettes become oriented as they travel around feeder bowl 10 so that they fall or roll down transfer chute 11 in a direction perpendicular to their longitudinal axis. The feed bin is preferably a 10 cubic foot MOD VBFB-10-D unit manufactured by Arthur G. Russell Co. of Bristol, Conn. This unit feeds cigarettes to feeder bowl 10 at a rate of up to 2000 cigarettes per minute. Feeder bowl 10 is preferably a 34 inch diameter CCW MOD VBF-30C unit also manufactured by Arthur G. Russell Co. of Bristol, Conn. This unit feeds cigarettes to transfer chute 11 at a rate of up to 600 cigarettes per minute. Transfer chute 11 may take any form desired consistent with the stated requirements.

The Conveying Means

Figure 1:
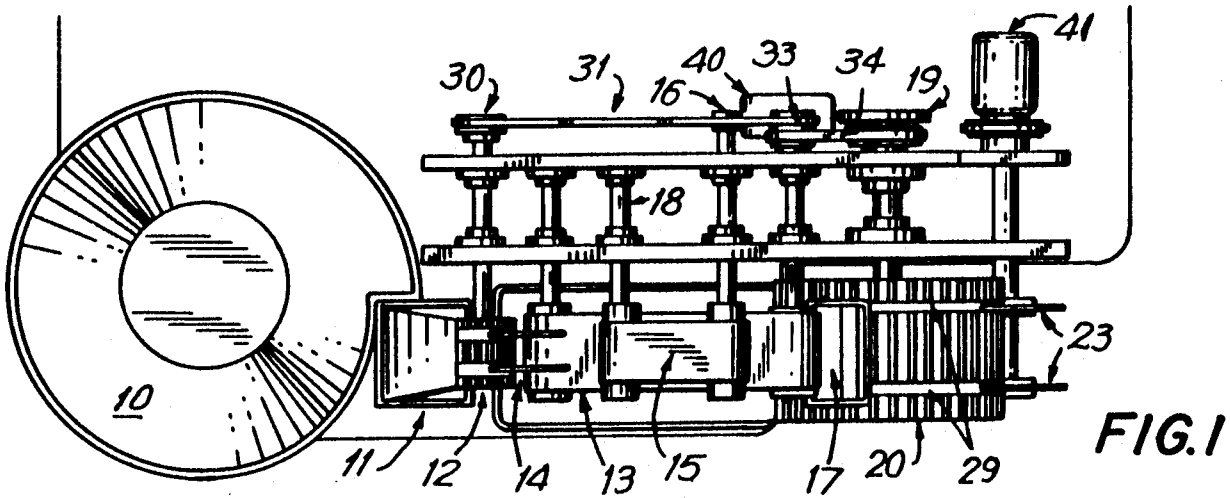
FIG. 1 is a plan view of an embodiment of the invention.

Suitable conveying means convey cigarettes from feeder bowl 10 to the detipping station. As illustrated in FIGS. 1 and 2, the conveying means preferably is comprised of a fluted rotating drum 12, slide rails 14, flexible conveyor belt 13, and rolling belt 15.

Rotating drum 12 is driven by motor 40 via pulley 30 and belt 31. Belt 31 is driven by pulley 33 and belt 34.

Preferably the motor is a ¾ horsepower Boston Gear reduction motor. Drum 12 has a plurality of uniformly sized and spaced flutes or grooves disposed about its circumference. Preferably 20 flutes are used on drum 12 which is preferably 4 inches wide with a 6 inch diameter. Each flute or groove extends in a direction parallel to the axis of rotation of drum 12 and is sized to carry only one cigarette. Each cigarette is nested in one of the flutes. Thus, as drum 12 rotates, the flutes receive cigarettes consecutively from transfer chute 11 and deposit the cigarettes on slide rails 14.

Slide rails 14 receive the cigarettes from drum 12 and the cigarettes roll down slide rails 14 to conveyor belt 13. Preferably slide rails 14 are comprised of two spaced apart rails. The rails are spaced slightly less than the length of a conventional filter cigarette from each other. This configuration allows broken or bent cigarettes to drop between slide rails 14 into a collection bin (not shown) for processing by other means.

Belt 31 is trained around pulleys 30 and 33. Pulley 33 is driven by means of motor 40, belt 22, pulley 19 and belt 34. Thus, conveyor belt 13 moves cigarettes from slide rails 14 to a second rotating fluted drum 20. Pulley 30 is about 20 inches from pulley 33 center to center. Conveyor belt 13 preferably operates at about 120 feet per minute.

The conveying means may also include rolling belt 15. Rolling belt 15 is positioned above conveyor belt 13 at a gap that is approximately equal to the diameter of the filter cigarettes being detipped. If desired, this gap may be increased or decreased to adjust the pressure that rolling belt 15 exerts on the cigarettes. In this manner, rolling belt 15 will exert a small amount of lateral pressure on the cigarettes to be detipped. This lateral pressure straightens slightly bent cigarettes and improves the flatness of uneven cigarettes.

Rolling belt 15 is driven by motor 40 via pulley 16 and belt 31. Pulleys 16 and 18 are about nine inches apart center to center. Rolling belt 15 travels slightly faster than conveyor belt 13. This causes the cigarettes to be rolled between rolling belt 15 and conveyor belt 13 which in turn straightens any bent cigarettes. This procedure facilitates proper alignment and movement of the cigarettes in the flutes of drum 20 prior to the detipping operation.

The cigarettes are then transferred from conveyor belt 13 onto drum 20 via transfer chute 17. Transfer chute 17 may be in any form but is preferably a slide through which the cigarettes slide or roll in a direction perpendicular to their longitudinal axis.

Detipping Means

Drum 20 has a plurality of flutes or grooves disposed along its circumference. Preferably drum 20 has a 14 inch diameter with 36 flutes. These flutes are sufficiently wide to hold only one cigarette. The flutes extend in a direction parallel to the axis of rotation of drum 20 and also extend across the entire width of drum 20. Drum 20 is caused to rotate by motor 40 via pulley 19 and belt 32. As drum 20 rotates, each flute of drum 20 picks up one cigarette from transfer chute 17. Preferably drum 20 rotates at about 16 rpm.

The cigarettes are transferred by transfer chute 17 onto drum 20. The cigarettes are blown by one or more air jets 25 to one side of drum 20. Preferably one air jet 25 is used to blow the cigarettes to the front side, i.e., the side away from motor 40 in FIG. 1, of drum 20. Air jet 25 preferably supplies about 20 psi of pressure and operates continuously.

In the preferred embodiment, a sensor 21 is positioned near the side of drum 20 along which all of the cigarettes are located either by transfer chute 17 or air jet 25. If the tobacco rod of a cigarette is facing sensor 21, that cigarette must be moved to the other side of drum 20 so that the filter tip portion of that cigarette is adjacent that side of drum 20. Sensor 21, such as an optical sensor, model C-41-101, manufactured by Skan-a-matic Co., Route 5 West, Elbridge, N.Y. 13060, distinguishes between light, which corresponds to the white filter of the cigarette to be detipped, and dark, which corresponds to the brown tobacco. When sensor 21 determines that the tobacco rod of a cigarette is adjacent to sensor 21, a signal is sent to air jet 22 to direct a jet of air against the sensed cigarette. Preferably a pressure of 40 psi is used for air jet 22. The sensed cigarette is thus blown to the other side of drum 20 and positioned by back stop **26*b***.

Figure 5:
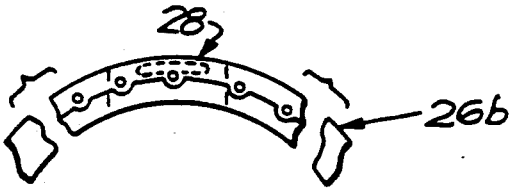
FIG. 5 is a partial sectional view taken along lines 5—5 of FIG. 4.

Back stops **26*a* and 26*b* may be located adjacent either side of drum 20 to prevent any cigarettes from falling off of the side of drum 20 and to properly align the cigarettes adjacent the outside edge of drum 20. In addition, a vacuum block 28 may be positioned behind either or both back stop 26*a* and 26*b*. Preferably vacuum block 28 is positioned behind back stop 26*b* and employs a vacuum pump capable of operating at a negative pressure of 18 to 20 inches of mercury. Back stops 26*a* and 26*b* rotate with drum 20 and may have air flow passages adjacent each flute of drum 20. (See FIG. 5) In this way, cigarettes rotating past vacuum block 28 will be drawn against back stop 26*b*. Thus, cigarettes blown against backstop 26*b* will not bounce back but will be initially held against backstop 26*b* by vacuum block 28. Another vacuum block may also be positioned against backstop 26*a* and backstop 26*a* may also have air flow passages therethrough adjacent each flute of drum 20 for proper alignment of the cigarettes against backstop 26*a*. Backstops 26*a* and 26*b* may be adjustable to vary the distance from the outside edge of drum 20 to backstops 26*a* and 26*b***.

Drum 20 is provided with two annular slits 29 around its entire circumference. Annular slits 29 should be at least as deep as the depth of the flutes of drum 20 and preferably deeper. Preferably annular slits 29 extend at least about 7/16 of an inch below the bottom of the flutes of drum 20. Annular slits 29 should also be equal distances from the center of the width of drum 20 and the distance between annular slits 29 should be at least equal to about the length of a tobacco rod of a conventional filter cigarette. For example, for a Parliament CA Brand cigarette the distance should be about 2¾ inches. In addition, the distance from backstops **26*a* and 26*b* to the nearest annular slit 29** should be equal to about the length of a filter of a typical filter cigarette. Preferably this distance is about 1¼ inches.

Knives 23 are positioned so that one knife 23 intersects drum 20 along one annular slit 29 and the other knife 23 intersects drum 20 along the other annular slit 29. Rotating knives 23 are caused to rotate via motor 41 and belt 24. Preferably a ¼ horsepower AC motor rotating at 1725 rpm is used.

As can be seen from the foregoing description, the cigarettes are aligned on drum 20 so that the filter tip portions are adjacent either side of drum 20 and cigarettes are positioned and held in place on drum 20 so that cigarettes cross annular slits 29 of drum 20 at about the point where the filter portion is connected to the tobacco rod. Knives 23 are aligned so that they will engage the cigarettes to be detipped only at the portion of the cigarette where the tobacco rod is connected to the filter tip. In this way, the filter tip portion will not be cut contaminating the tobacco with filter material, nor will the tobacco in the tobacco rod be cut resulting in degradation of the tobacco to be reclaimed.

After the cigarettes are detipped, the tobacco rods and filter tips are collected separately in collection bins 45 and 60 for recycling. Guides 39 may be fitted into annular slits 29 downstream of rotating knives 23. Guides 39 ensure that the tobacco rods of the detipped cigarettes fall off of drum 20 as it rotates past the knives 23 into one collection bin and the filter tips fall into other collection bins.

A second sensor 51, which is also preferably an optical sensor, model C-42-101 manufactured by Skan-a-matic Co., may be used to review cigarettes after the detipping operation. Sensor 51 may be positioned downstream of knives 23 between annular slits 29. If a filter tip is detected, air jet 52 shifts the cigarette to either backstop 26*a* or 26*b* where the cigarette is preferably held in place by a vacuum. Preferably 5 psi air pressure is used in air jet 52. The cigarette is then held in place against drum 20 by rail 53, which is adjacent either backstop 26*a* or 26*b* depending on to which backstop the cigarette was shifted. The cigarette then drops into container 54 for recycling by other means. A final air jet 55 downstream of rail 53 may be directed against the flutes of drum 20 to dislodge any cigarettes stuck in the flutes. Preferably air jet 55 operates at 30 psi of pressure.

Guards and covers (not shown) may be added around the moving parts of the apparatus to enhance personnel safety. Also, a shop vacuum (not shown) may be added to the apparatus of this invention to prevent dust caused by the detipping operation from covering the sensors.

One skilled in the art will appreciate that the present invention can be practiced by other than the described embodiments, which are presented for purposes of illustration and not of limitation, and the present invention is limited only by the claims which follow.

What is claimed is:

1. An apparatus for detipping filter cigarettes, comprising:

(a) conveying means for feeding said filter cigarettes side by side in a direction perpendicular to their longitudinal axis;

(b) moving means having two sides adjacent to said conveying means for receiving said filter cigarettes;

(c) first positioning means adjacent to said moving means for positioning said filter cigarettes all on one side of said moving means;

(d) sensing means adjacent to said moving means to sense whether the filter tip portions or the tobacco rods of said filter cigarettes are adjacent said sensing means;

(e) second positioning means adjacent to said moving means to move said filter cigarettes across the width of said moving means to ensure that only the filters of said filter cigarettes or only the tobacco rods of said filter cigarettes are adjacent either side of said moving means; and (f) cutting means adjacent to said moving means to cut the filter tip portions from the tobacco rods of said cigarettes.

2. The apparatus of claim 1 wherein said cutting means is a pair of rotating circular knives.

3. The apparatus of claim 1 wherein said moving means is a fluted rotating drum.

4. The apparatus of claim 1 wherein said first positioning means is an air jet.

5. The apparatus of claim 1 wherein said first positioning means is a transfer chute.

6. The apparatus of claim 1 wherein said sensing means is an optical sensor.

7. The apparatus of claim 1 wherein said second positioning means is an air jet.

8. The apparatus of claim 1 further comprising a second sensing means adjacent to said cutting means to detect improperly detipped cigarettes.

9. The apparatus of claim 8 wherein said second sensing means is an optical sensor.

10. The apparatus of claim 9 further comprising a third positioning means adjacent to said second sensing means for positioning improperly detipped cigarettes along one side of said moving means.

11. The apparatus of claim 10 wherein said third positioning means is an air jet.

12. The apparatus of claim 10 further comprising a rail adjacent to said third positioning means to hold improperly detipped cigarettes against said moving means.

13. The apparatus of claim 12 further comprising a dislodging means adjacent to said rail to dislodge cigarettes from said moving means.

14. The apparatus of claim 13 wherein said dislodging means is an air jet.

15. The apparatus of claim 1 further comprising one back stop positioned along one side of said moving means.

16. The apparatus of claim 15 further comprising a vacuum block adjacent said back stop and wherein said back stop has a plurality of air flow passages therethrough.

17. The apparatus of claim 15 wherein said back stop rotates with said moving means.

18. The apparatus of claim 16 wherein said back stop rotates with said moving means.

19. The apparatus of claim 15 further comprising a second back stop positioned along the other side of said moving means.

20. The apparatus of claim 19 wherein said second backstop rotates with said moving means.

21. The apparatus of claim 19 further comprising a vacuum block adjacent said second back stop and wherein said second back stop has a plurality of air flow passages therethrough.

22. The apparatus of claim 21 wherein said back stop rotates with said moving means.

23. The apparatus of claim 15 further comprising a second sensing means adjacent to said cutting means to detect improperly detipped cigarettes.

24. The apparatus of claim 23 wherein said second sensing means is an optical sensor.

25. The apparatus of claim 23 further comprising a third positioning means adjacent to said second sensing means for positioning improperly detipped cigarettes along one side of said moving means.

26. The apparatus of claim 25 wherein said third positioning means is a air jet.

27. The apparatus of claim 25 further comprising a rail adjacent to said third positioning means to hold improperly detipped cigarettes against said moving means.

28. The apparatus of claim 27 further comprising a dislodging means adjacent to said rail to dislodge cigarettes from said moving means.

29. The apparatus of claim 28 wherein said dislodging means is an air jet.

30. The apparatus of claim 19 further comprising a second sensing means adjacent to said cutting means to detect improperly detipped cigarettes.

31. The apparatus of claim 30 wherein said second sensing means is an optical sensor.

32. The apparatus of claim 30 further comprising a third positioning means adjacent to said second sensing means for positioning improperly detipped cigarettes along one side of said moving means.

33. The apparatus of claim 32 wherein said third positioning means is an air jet.

34. The apparatus of claim 32 further comprising a rail adjacent to said third positioning means to hold improperly detipped cigarettes against said moving means.

35. The apparatus of claim 34 further comprising a dislodging means adjacent to said rail to dislodge cigarettes from said moving means.

36. The apparatus of claim 35 wherein said dislodging means is an air jet.

37. The apparatus of claim 1 wherein said moving means has a pair of annular slits along its entire surface.

38. The apparatus of claim 37 wherein said pair of annular slits is spaced apart a distance equal to about the length of a tobacco rod of a conventional filter tipped cigarette.

39. The apparatus of claim 38 wherein said cutting means rotates through said pair of annular slits.

40. The apparatus of claim 39 wherein said cutting means is a pair of rotating circular knives.

41. The apparatus of claim 15 wherein said moving means has a pair of annular slits along its entire surface.

42. The apparatus of claim 41 wherein said pair of annular slits is spaced apart a distance equal to about the length of a tobacco rod of a conventional filter tipped cigarette.

43. The apparatus of claim 42 wherein said cutting means rotates through said pair of annular slits.

44. The apparatus of claim 43 wherein said cutting means is a pair of rotating circular knives.

45. The apparatus of claim 19 wherein said moving means has a pair of annular slits along its entire surface.

46. The apparatus of claim 45 wherein said pair of annular slits is spaced apart a distance equal to about the length of a tobacco rod of a conventional filter tipped cigarette.

47. The apparatus of claim 46 wherein said cutting means rotates through said pair of annular slits.

48. The apparatus of claim 47 wherein said cutting means is a pair of rotating circular knives.

49. The apparatus of claim 37 further comprising a second sensing means adjacent to said cutting means to detect improperly detipped cigarettes.

50. The apparatus of claim 49 wherein said second sensing means is an optical scanner.

51. The apparatus of claim 49 further comprising a third positioning means adjacent to said second sensing means for positioning improperly detipped cigarettes along one side of said moving means.

52. The apparatus of claim 51 wherein said third positioning means is an air jet.

53. The apparatus of claim 51 further comprising a rail adjacent to said third positioning means to hold improperly detipped cigarettes against said moving means.

54. The apparatus of claim 53 further comprising a dislodging means adjacent to said rail to dislodge cigarettes from said moving means.

55. The apparatus of claim 54 wherein said dislodging means is an air jet.

56. The apparatus of claim 1 wherein said conveying means is an endless rotating belt.

57. The apparatus of claim 56 wherein said conveying means further comprises a rolling belt above said endless rotating belt.

58. The apparatus of claim 2 wherein said moving means is a fluted rotating drum.

59. The apparatus of claim 58 wherein said first positioning means is an air jet.

60. The apparatus of claim 59 wherein said sensing means is an optical sensor.

61. The apparatus of claim 60 wherein said second positioning means is an air jet.

62. The apparatus of claim 61 wherein said moving means has a pair of annular slits along its entire surface.

63. The apparatus of claim 62 wherein said pair of annular slits are spaced apart from each other a distance equal to about the length of a tobacco rod of a conventional filter tipped cigarette.

64. The apparatus of claim 63 wherein said cutting means rotates through said pair of annular slits.

65. The apparatus of claim 64 wherein said conveying means is an endless rotating belt.

66. The apparatus of claim 65 wherein said conveying means further comprises a rolling belt above said endless rotating bet.

67. The apparatus of claim 66 further comprising a second sensing means adjacent to said cutting means to detect improperly detipped cigarettes.

68. The apparatus of claim 67 wherein said second sensing means is an optical sensor.

69. The apparatus of claim 68 further comprising a third positioning means adjacent to said second sensing means for positioning improperly detipped cigarettes along one side of said moving means.

70. The apparatus of claim 69 wherein said third positioning means is an air jet.

71. The apparatus of claim 70 further comprising a rail adjacent to said third positioning means to hold improperly detipped cigarettes against said fluted rotating drum.

72. The apparatus of claim 71 further comprising a dislodging means adjacent to said rail to dislodge cigarettes from the flutes of said fluted rotating drum.

73. The apparatus of claim 72 wherein said dislodging means is an air jet.

74. The apparatus of claim 73 further comprising one back stop positioned along one side of said moving means.

75. The apparatus of claim 74 further comprising a vacuum block adjacent said back stop wherein said back stop has a plurality of air flow passages therethrough.

76. The apparatus of claim 75 wherein said back stop rotates with said fluted rotating drum.

77. The apparatus of claim 76 further comprising a second back stop positioned along the other side of said moving means.

78. The apparatus of claim 77 further comprising a vacuum block adjacent said second back stop wherein said second back stop has a plurality of air flow passages therethrough.

79. The apparatus of claim 78 wherein said second back stop rotates with said moving means.

80. A method of detipping cigarettes comprising:

(a) carrying said cigarettes on a conveying means having two sides;

(b) sensing the orientation of said cigarettes on said conveying means;

(c) aligning said cigarettes on said conveying means so the filter tip portions of said cigarettes are all adjacent either side of said conveying means; and (d) cutting off the filter tip portion of said cigarettes.

81. The method of claim 80 further comprising sensing the cigarettes after cutting off the filter tip portion of said cigarettes to reclaim any cigarette whose filter tip portion has not been cut off.

* * * * *